US007951053B1

(12) United States Patent
Christian

(10) Patent No.: US 7,951,053 B1
(45) **Date of Patent: *May 31, 2011**

(54) EXERCISING ASSIST METHOD AND APPARATUS

(76) Inventor: Christopher L. Christian, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/690,654

(22) Filed: Jan. 20, 2010

Related U.S. Application Data

(63) Continuation-in-part of application No. 12/062,341, filed on Apr. 3, 2008, now Pat. No. 7,674,213.

(51) Int. Cl.
*A63B 21/00* (2006.01)

(52) U.S. Cl. ..... 482/132

(58) Field of Classification Search ..... 482/132, 482/62, 141, 148, 91, 139, 51, 907
See application file for complete search history.

(56) References Cited

U.S. PATENT DOCUMENTS

| | | | | |
|---|---|---|---|---|
| 3,672,670 | A | 6/1972 | Burzenski | |
| 3,784,192 | A | 1/1974 | Nutter | |
| 4,595,197 | A | 6/1986 | Hagstrom et al. | |
| 5,004,229 | A | 4/1991 | Lind | |
| D341,861 | S | 11/1993 | Chen | |
| 6,942,605 | B1 * | 9/2005 | Sukhovitsky | 482/132 |
| 7,674,213 | B1 * | 3/2010 | Christian | 482/132 |

* cited by examiner

*Primary Examiner* — Lori Baker

(57) ABSTRACT

An exercising assist method and apparatus for includes a pair of foot engaging members each having a structure to be removably coupled to a foot of a person. A pair of wheel assemblies is provided and each of the foot engaging members has one of the wheel assemblies attached thereto. The wheel assemblies engage a wall surface when the foot of the person is pointed toward the wall surface. The wheel assemblies assist the person in performing exercises.

13 Claims, 8 Drawing Sheets

EXERCISING ASSIST METHOD AND APPARATUS

This application is a continuation in part of U.S. patent application Ser. No. 12/062,341 file on Apr. 3, 2008 now U.S. Pat. No. 7,674,213.

BACKGROUND OF THE INVENTION

Field of the Invention

The present invention relates to exercising assisting devices and more particularly pertains to a new exercising assisting device for assisting a person in doing some exercises while allowing new excises to be performed.

SUMMARY OF THE INVENTION

The present invention meets the objectives presented above by generally comprising a pair of foot engaging members each having a structure to be removably coupled to a foot of a person. A pair of wheel assemblies is provided and each of the foot engaging members has one of the wheel assemblies attached thereto. The wheel assemblies engage a wall surface when the foot of the person is pointed toward the wall surface. The wheel assemblies assist the person in performing exercises.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
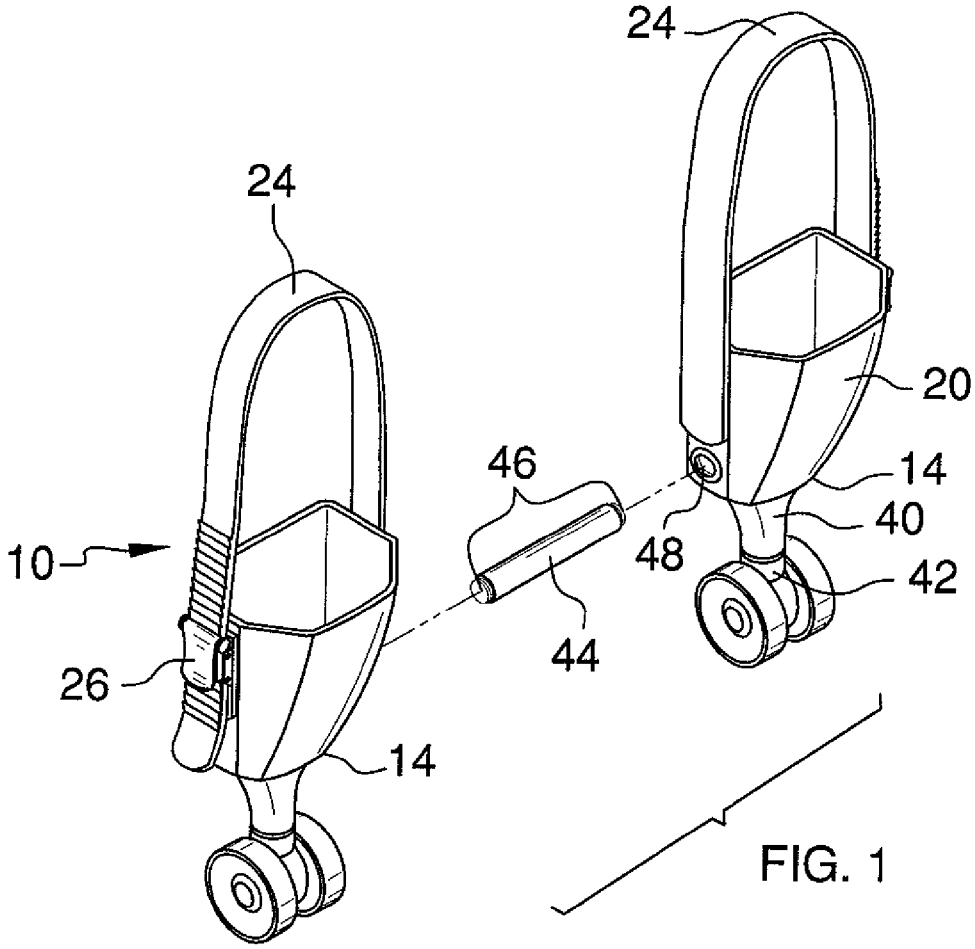
FIG. 1 is a perspective expanded view of a exercising assist method and apparatus according to the present invention.
Figure 2:
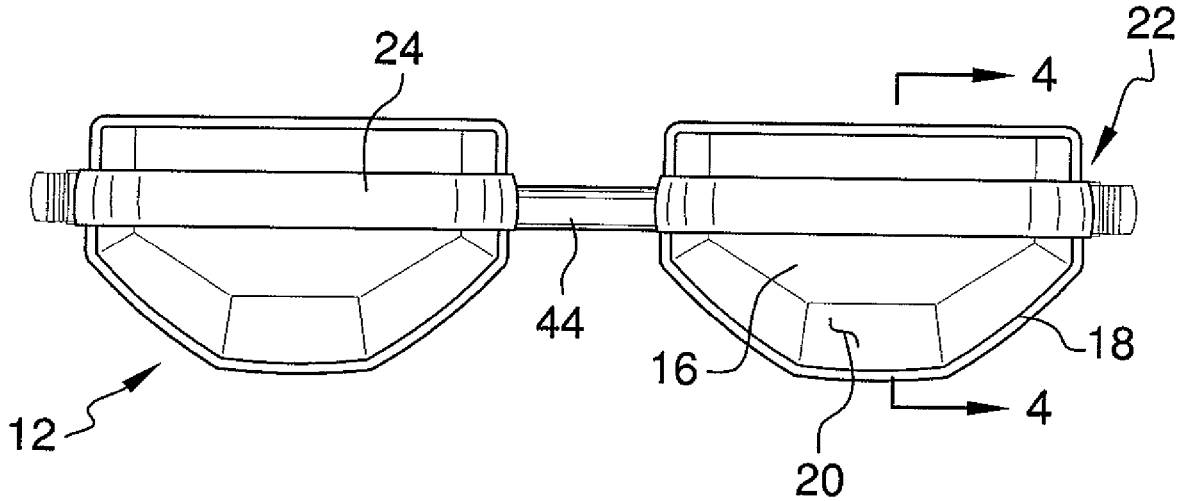
FIG. 2 is a top view of the present invention.

With reference now to the drawings, and in particular to FIGS. 1 through 17 thereof, a new exercising assisting device embodying the principles and concepts of the present invention and generally designated by the reference numeral 10 will be described.

As best illustrated in FIGS. 1 through 17, the exercising assist method and apparatus 10 generally comprises a pair of foot engaging members 12 each having a structure to be removably coupled to a foot 6 of a person 7. Each of the foot engaging members 12 comprises a housing 14 that has a closed end 16, an open end 18 and a perimeter wall 20 extending between the open 18 and closed 16 ends. The open end 18 has a shape to receive a toe end of a foot 6 of a person 7. The shape may be such to accommodate a foot 6 with or without a shoe positioned thereon. A securing member 22 is attached to the housing 14 to releasably secure a foot 6 in the housing 14. The securing member 22 comprises a strap 24 that is attached to the housing 14 and traverses the open end 18, wherein the strap 24 is releasably abuttable against a heal portion of the foot 6 to retain the toe end in the housing 14. The straps 24 may include ratchet type buckles 26 used to quickly secure the housing 14 to the person's foot 6 or shoe.

A pair of wheel assemblies 28 is provided. Each of the foot engaging members 12 has one of the wheel assemblies 28 attached thereto. The wheel assemblies 28 engage a wall surface 30 when the foot 6 of the person 7 is pointed toward the wall surface 30. The wall surface 30 may either be a vertical wall surface or a floor surface. Each of the wheel assemblies 28 includes a post 32 that is attached to and extends forward of an associated one of the foot engaging members 12. The post 32 has a distal end 34 with respect to the associated one of the foot engaging members 12. An axle 36 is attached to the post 32 adjacent to the distal end 34. At least one wheel 38, and up to a pair of wheels 38, is rotatably attached to the axle 36. If a pair of wheels 38 is used, the wheels 38 have a common axis of rotation. The post 32 includes a first portion 40 and a second portion 42 rotationally coupled to each other to allow the axle 36 to swivel with respect to the associated one of the foot engaging members 12. The swiveling of the axle 36 allows a person to move the feet across the wall 30 surface at angles as well as along straight lines.

Figure 3:
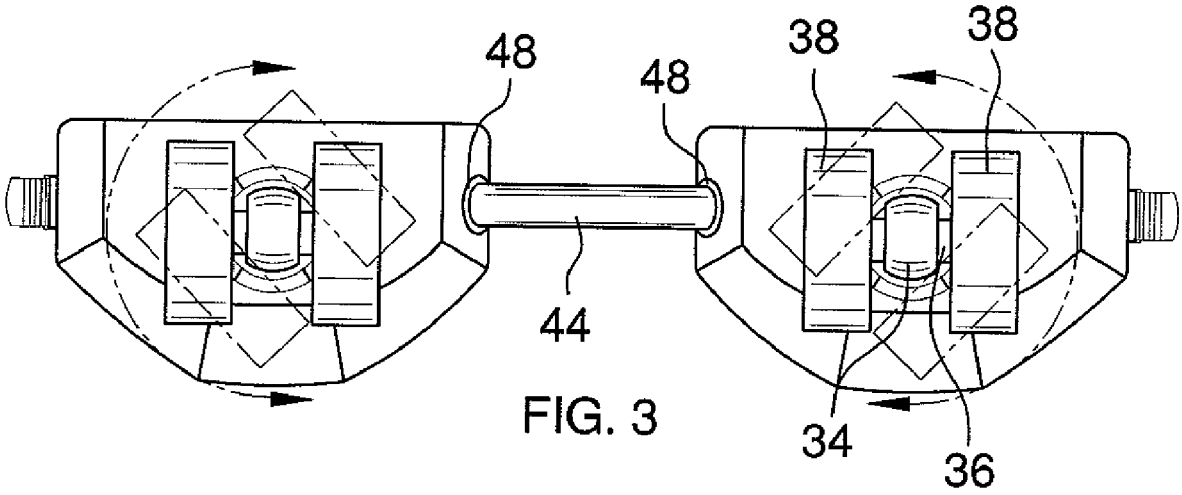
FIG. 3 is a bottom view of the present invention.
Figure 4:
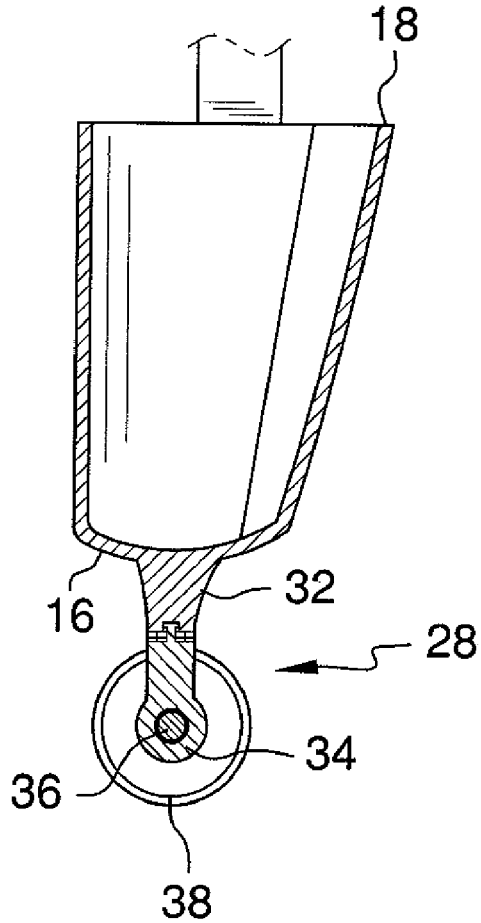
FIG. 4 is a cross-sectional view taken along line 4-4 of FIG. 2 of the present invention.
Figure 5:
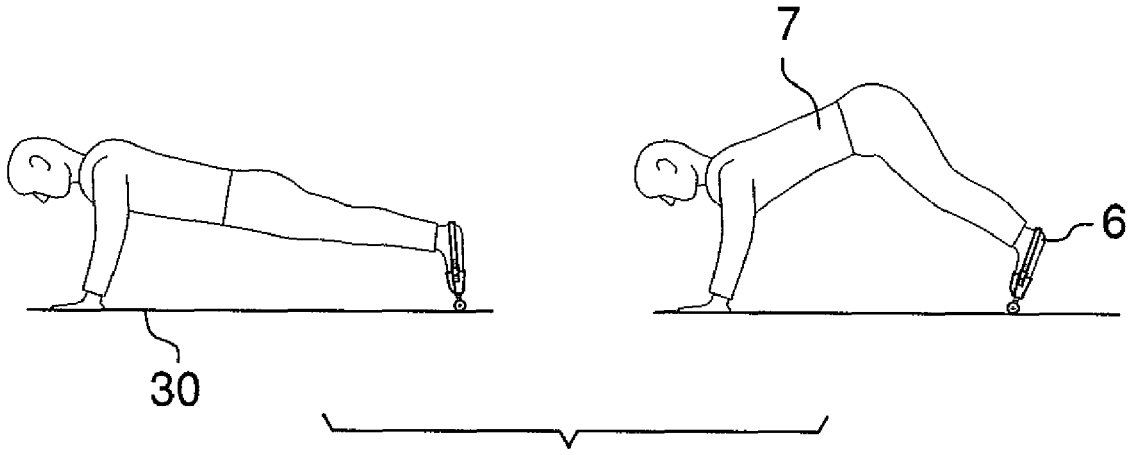
FIG. 5 is a side in-use view of the present invention.
Figure 6:
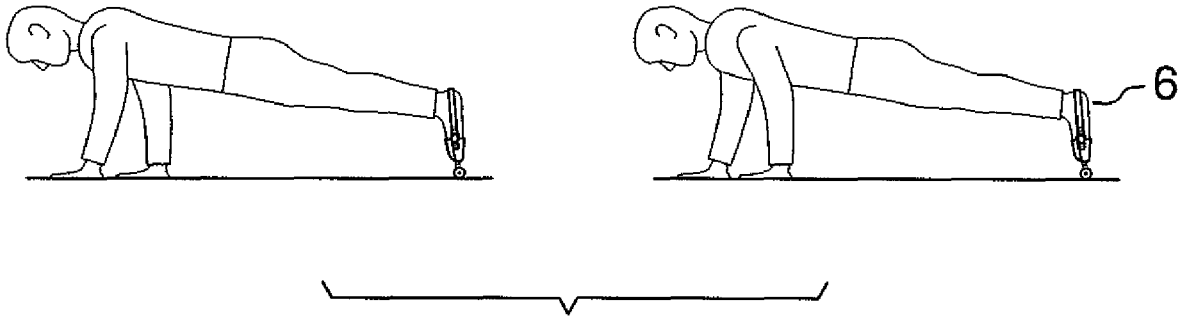
FIG. 6 is a side in-use view of the present invention.
Figure 7:
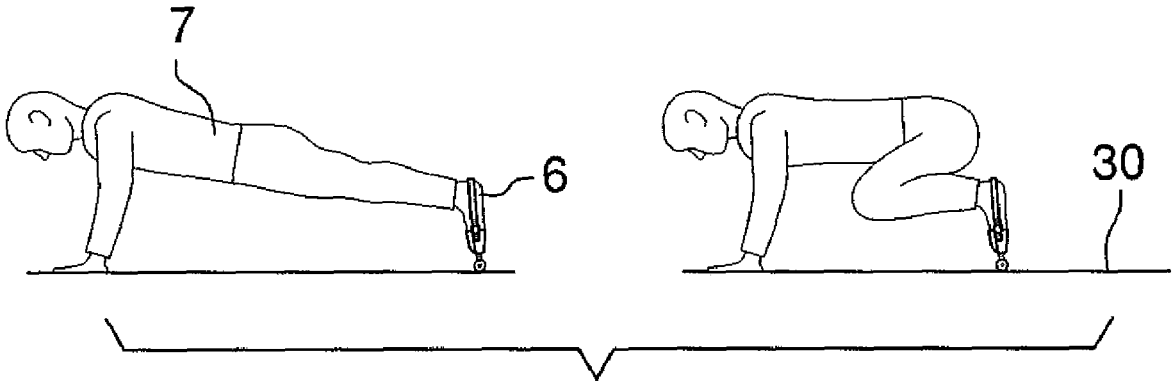
FIG. 7 is a side in-use view of the present invention.
Figure 8:
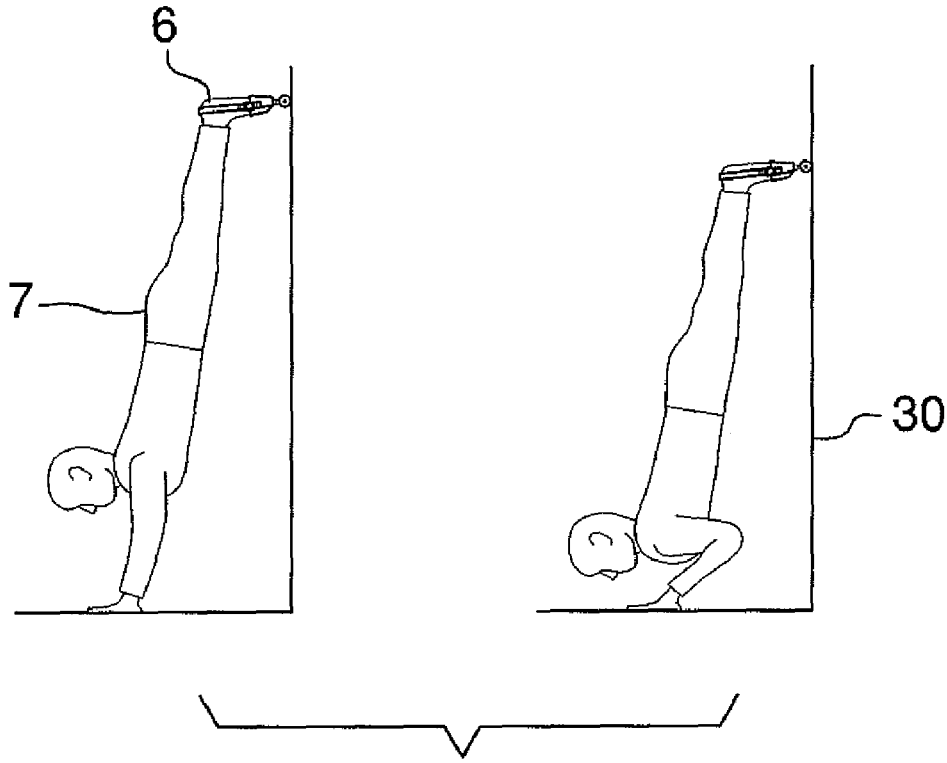
FIG. 8 is a side in-use view of the present invention.
Figure 9:
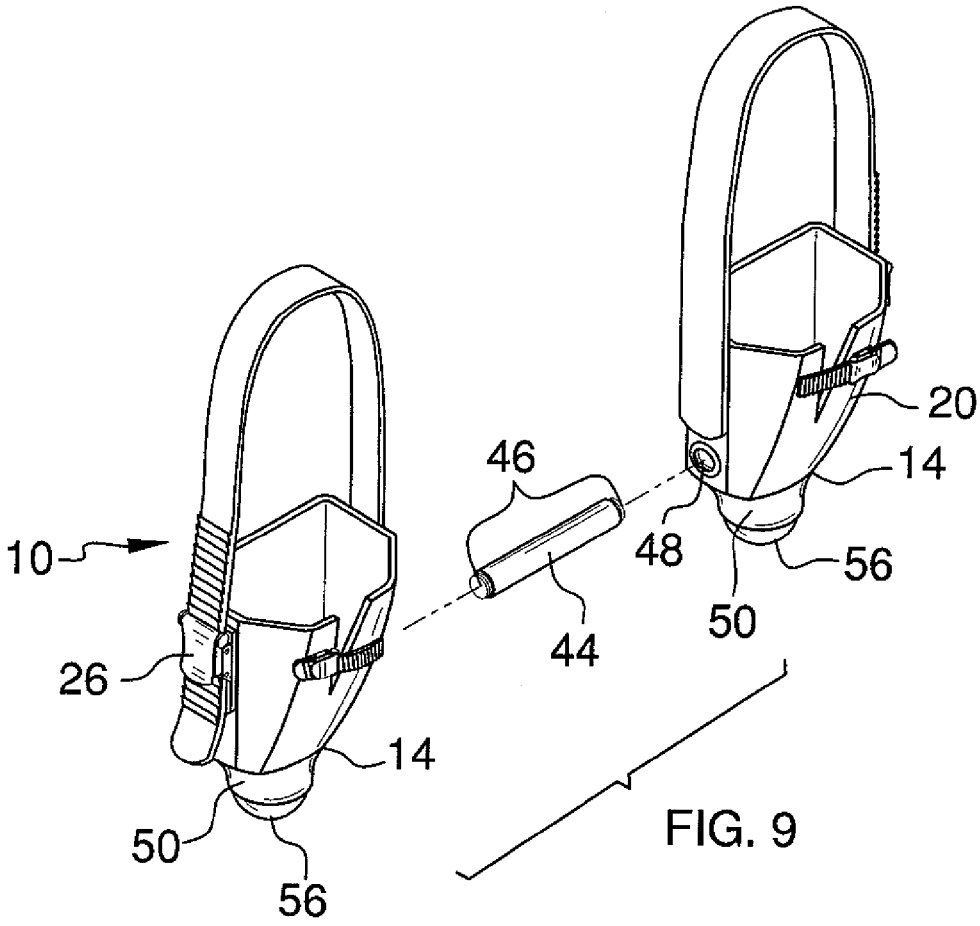
FIG. 9 is a perspective expanded view of an embodiment according to the present invention.
Figure 10:
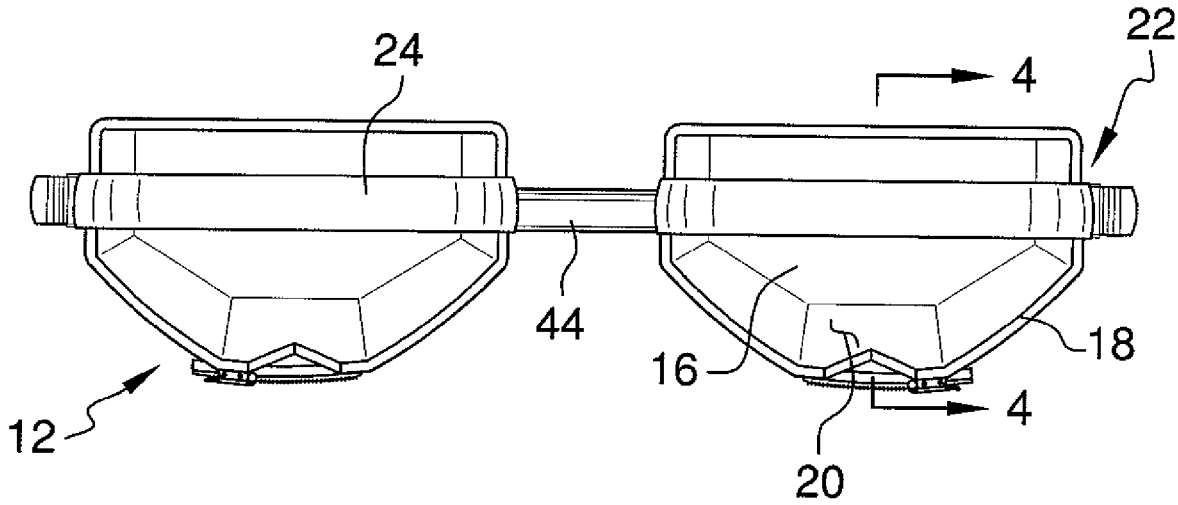
FIG. 10 is a top view of an embodiment of the present invention.
Figure 11:
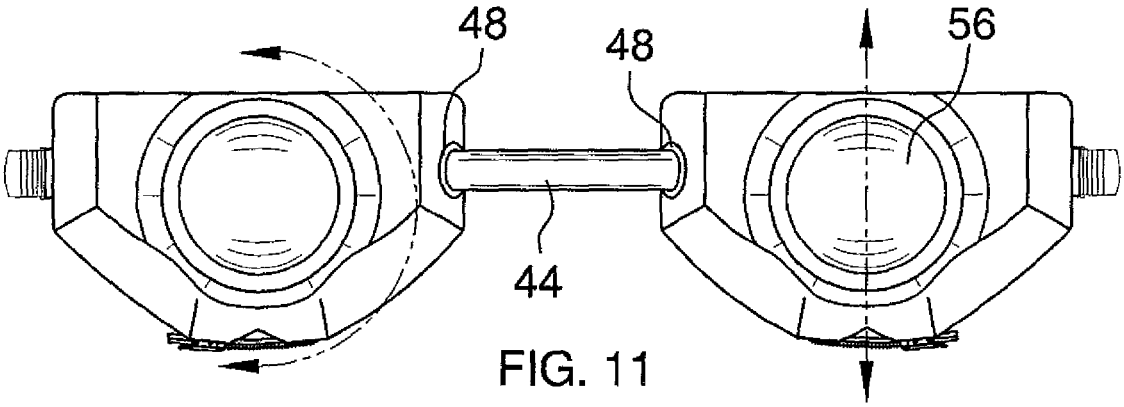
FIG. 11 is a bottom view of an embodiment of the present invention.

A connecting rod 44 may be used that is extended between and removably coupled to the foot engaging members 12. The connecting rod 44 removably couples the foot engaging members 12 together and so that they are in alignment with each other as shown in FIG. 3. The connecting rod 44 is straight and rigid and has a pair of ends defining first couplers 46. Each of the perimeter walls 20 of the foot engaging members 12 has a second coupler mounted thereon 48. The first couplers 46 are removably attached to the second couplers 48 to secure together and laterally align the housings 14 with each other.

Figure 12:
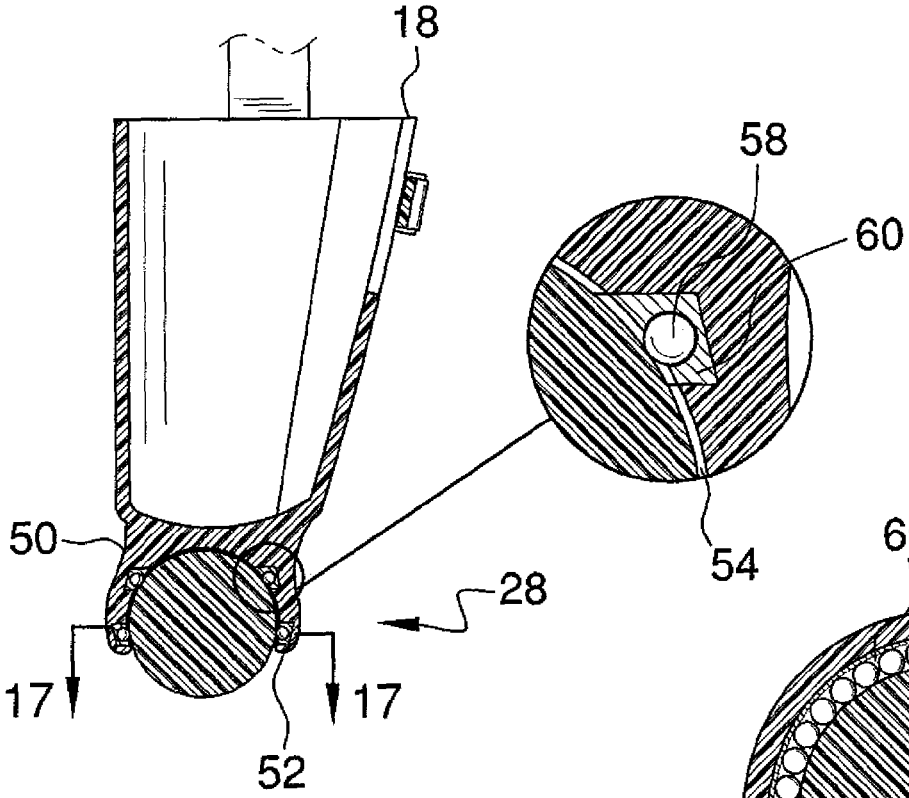
FIG. 12 is a cross-sectional view taken along line 12-12 of FIG. 10 of an embodiment of the present invention.
Figure 17:
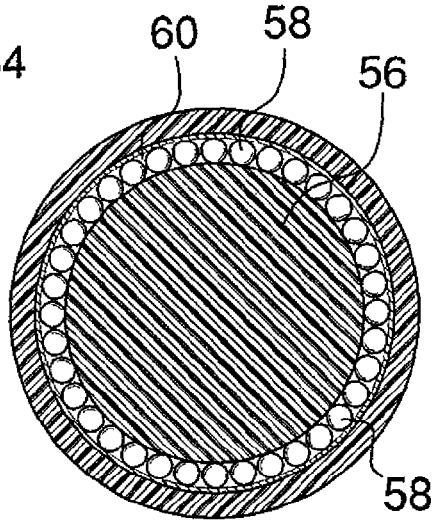
FIG. 17 is a cross-sectional view taken along line 17-17 of FIG. 10 of an embodiment of the present invention.

As shown in FIGS. 9-17, the wheel assemblies 28 may each include a mounting 50 that is attached to and extends forward of an associated one of the foot engaging members 12. The mounting 50 has a distal end 52 with respect to the associated one of the foot engaging members 12. The distal end 52 has a well 54 therein that has an arcuately concave shape. A sphere 56 is mounted in the well 54 and extends outwardly away from the distal end 52. The sphere 56 may be comprised of a plastic, composite or elastomeric material. The sphere 56 is rotatable with respect to the mounting 50. A plurality of bearings 58 is mounted in a surface of the well 54. The bearings 58 are rotatable and abut the sphere 56 to enhance rotation of the sphere 56 with respect to the mounting 50. Each well 54 may have at least three bearings 58 therein. FIG. 17 shows show the bearings 58 may be mounted within rings 60 mounted in the surface of the well 54, wherein the rings 60 can hold a plurality of packed bearings 58. Multiple rings may be used as shown in FIG. 12.

Figure 13:
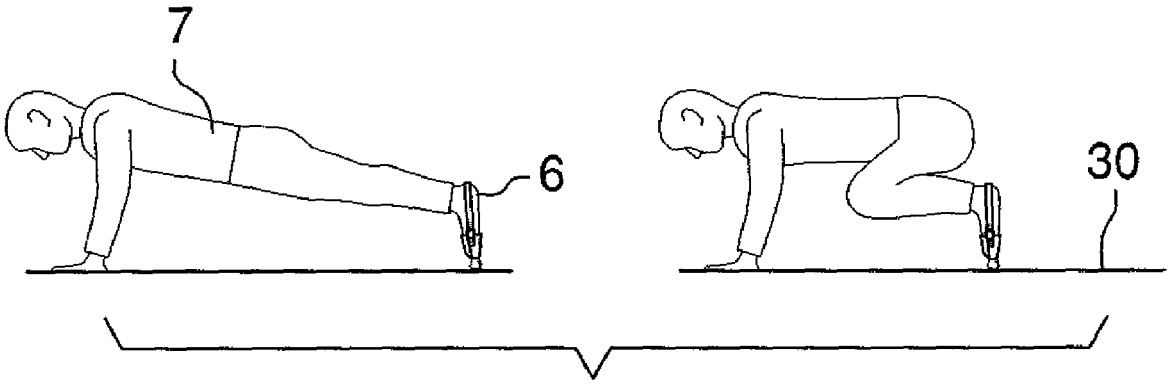
FIG. 13 is a side in-use view of an embodiment of the present invention.
Figure 14:
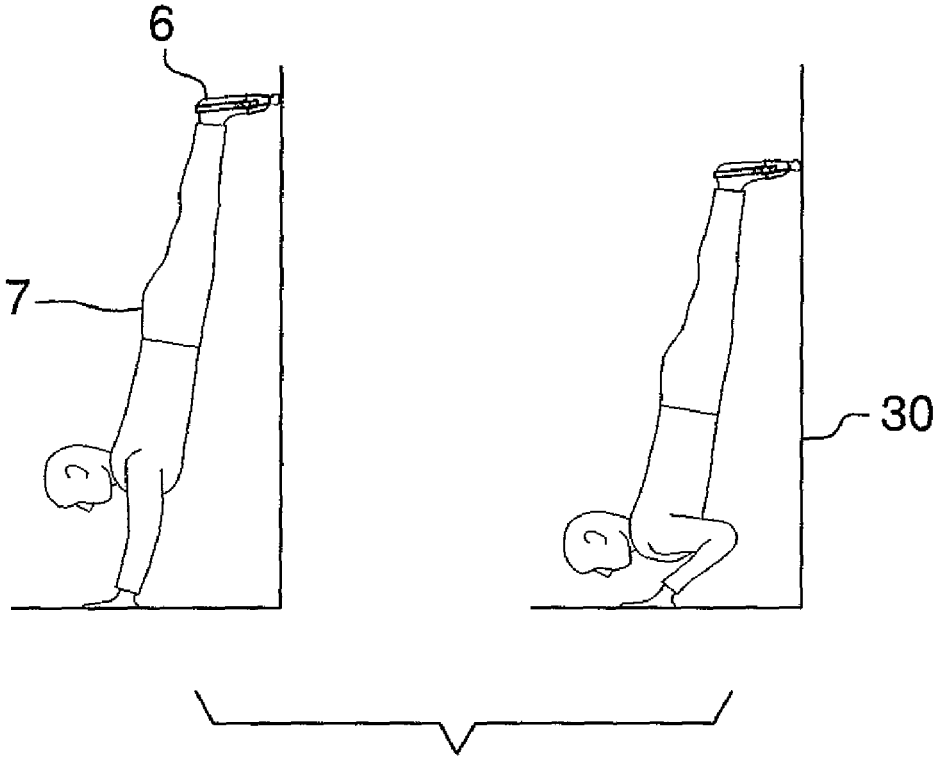
FIG. 14 is a side in-use view of an embodiment of the present invention.
Figure 15:
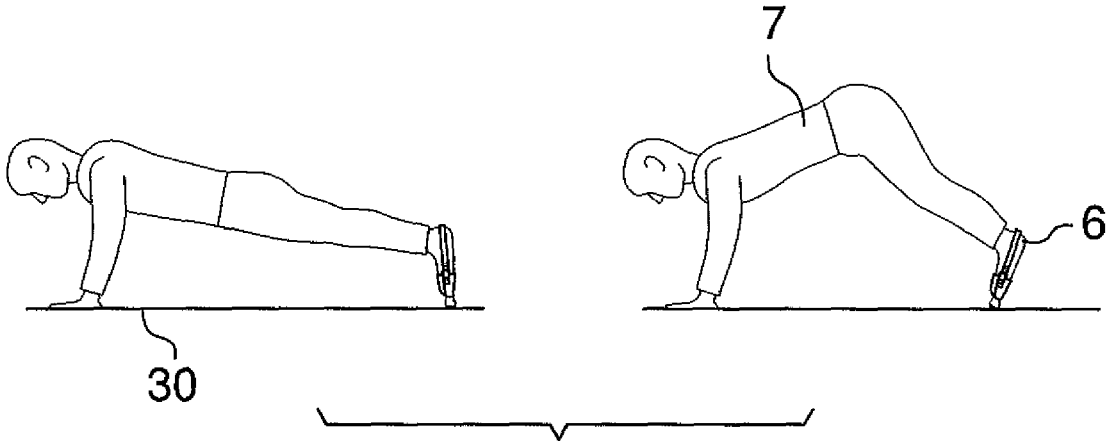
FIG. 15 is a side in-use view of an embodiment of the present invention.
Figure 16:
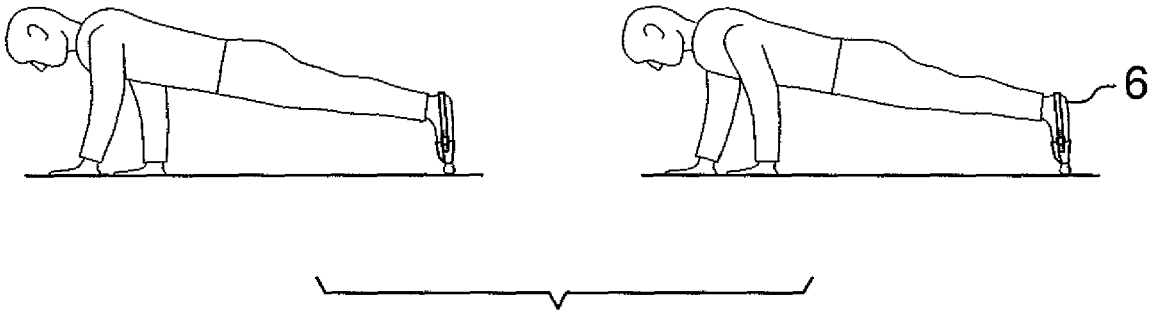
FIG. 16 is a side in-use view of an embodiment of the present invention.

In use, the person places their feet 6 in the housings 14 and secures the housings 14 to their feet 6. The person then performs various exercises with or without the connecting rod 44. While a variety of exercises may be performed with the apparatus 10 and according to the method, two exemplary exercises are shown in FIGS. 13-16. FIG. 13 depicts a leg and abdominal exercise made easier by the apparatus 10 in which the feet are rolled back and forth toward the hands while retaining the legs in a straight orientation. FIG. 16 teaches an abdominal and upper body exercise where the body is retaining in a straight, rigid state while the hands and arms are used to walk across a floor surface. FIG. 15 shows an abdomen work out wherein the feet are rolled back and forth toward the hands while the knees are bent. FIG. 14 depicts handstand pushups wherein the wheel assemblies allow for easy movement of the feet upwardly and downwardly along a vertical wall.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exercising assisting apparatus to be worn on feet, said apparatus comprising:

a pair of foot engaging members each having a structure to be removably coupled to a foot of a person, wherein each of said foot engaging members includes;

a housing having a closed end, an open end and a perimeter wall extending between the open and closed ends, wherein said open end has a shape to receive a toe end of a foot of a person; and a securing member being attached to said housing to releasably secure a foot in said housing;

a pair of wheel assemblies, each of said foot engaging members having one of said wheel assemblies attached thereto, wherein said wheel assemblies engage a wall surface when the foot of the person is pointed toward the wall surface, said wheel assemblies assisting the person in performing exercises, wherein each of said wheel assemblies includes;

a mounting being attached to and extending forward of an associated one of said foot engaging members, said mounting having a distal end with respect to the associated one of said foot engaging members, said distal end having a well therein having an arcuately concave shape; and a sphere being mounted in said well and extending outwardly away from said distal end, said sphere being rotatable with respect to said mounting.

2. The apparatus according to claim 1, wherein said securing member comprises strap being attached to said housing and traversing said open end, wherein said strap is releasably abuttable against a heel portion of the foot to retain the toe end in the housing.

3. The apparatus according to claim 1, wherein each of said wheel assemblies further includes a surface of said well having a plurality of bearing rotatably mounted therein, said bearings abutting said sphere to enhance rotation of said sphere with respect to said mounting.

4. The apparatus according to claim 1, further including a connecting rod being removably coupled to and extending between said foot engaging members, said connecting rod removably coupling said foot engaging members together and in alignment with each other.

5. The apparatus according to claim 1, further including a connecting rod being removably coupled to and extending between said foot engaging members, said connecting rod removably coupling said foot engaging members together and in alignment with each other, said connecting rod being straight and rigid and having a pair of ends defining first couplers, each of said perimeter walls of said foot engaging members having a second coupler mounted thereon, said first couplers being removably attached to said second couplers to secure together and laterally align said housings with each other.

6. The apparatus according to claim 3, further including a connecting rod being removably coupled to and extending between said foot engaging members, said connecting rod removably coupling said foot engaging members together and in alignment with each other, said connecting rod being straight and rigid and having a pair of ends defining first couplers, each of said perimeter walls of said foot engaging members having a second coupler mounted thereon, said first couplers being removably attached to said second couplers to secure together and laterally align said housings with each other.

7. An exercising assisting apparatus to be worn on feet, said apparatus comprising:

a pair of foot engaging members each having a structure to be removably coupled to a foot of a person, each of said foot engaging members comprising;

a housing having a closed end, an open end and a perimeter wall extending between the open and closed ends, wherein said open end has a shape to receive a toe end of a foot of a person;

a securing member being attached to said housing to releasably secure a foot in said housing, said securing member comprising a strap being attached to said housing and traversing said open end, wherein said strap is releasably abuttable against a heel portion of the foot to retain the toe end in the housing;

a pair of wheel assemblies, each of said foot engaging members having one of said wheel assemblies attached thereto, wherein said wheel assemblies engage a wall surface when the foot of the person is pointed toward the wall surface, each of said wheel assemblies including;

a mounting being attached to and extending forward of an associated one of said foot engaging members, said mounting having a distal end with respect to the associated one of said foot engaging members, said distal end having a well therein having an arcuately concave shape;

a sphere being mounted in said well and extending outwardly away from said distal end, said sphere being rotatable with respect to said mounting;

a plurality of bearings being mounted in a surface of said well, said bearings being rotatable and abutting said sphere to enhance rotation of said sphere with respect to said mounting; and a connecting rod being removably coupled to and extending between said foot engaging members, said connecting rod removably coupling said foot engaging members together and in alignment with each other, said connecting rod being straight and rigid and having a pair of ends defining first couplers, each of said perimeter walls of said foot engaging members having a second coupler mounted thereon, said first couplers being removably attached to said second couplers to secure together and laterally align said housings with each other.

8. An exercising assisting apparatus to be worn on feet, said apparatus comprising:

a pair of foot engaging members each having a structure to be removably coupled to a foot of a person;

a pair of wheel assemblies, each of said foot engaging members having one of said wheel assemblies attached thereto, wherein said wheel assemblies engage a wall surface when the foot of the person is pointed toward the wall surface, said wheel assemblies assisting the person in performing exercises; and a connecting rod being removably coupled to and extending between said foot engaging members, said connecting rod removably coupling said foot engaging members together and in alignment with each other.

9. The apparatus according to claim 8, wherein each of said foot engaging members comprises:

a housing having a closed end, an open end and a perimeter wall extending between the open and closed ends, wherein said open end has a shape to receive a toe end of a foot of a person, said wheel assembly being attached to and extending forward of said toe end of said housing; and a securing member being attached to said housing to releasably secure a foot in said housing.

10. The apparatus according to claim 9, wherein said securing member comprises strap being attached to said housing and traversing said open end, wherein said strap is releasably abuttable against a heel portion of the foot to retain the toe end in the housing.

11. The apparatus according to claim 9, wherein each of said wheel assemblies includes:

a mounting being attached to and extending forward of an associated one of said foot engaging members, said mounting having a distal end with respect to the associated one of said foot engaging members, said distal end having a well therein having an arcuately concave shape; and a sphere being mounted in said well and extending outwardly away from said distal end, said sphere being rotatable with respect to said mounting;

a plurality of bearings being mounted in a surface of said well, said bearings being rotatable and abutting said sphere to enhance rotation of said sphere with respect to said mounting.

12. The apparatus according to claim 11, wherein said connecting rod is straight and rigid and having a pair of ends defining first couplers, each of said perimeter walls of said foot engaging members having a second coupler mounted thereon, said first couplers being removably attached to said second couplers to secure together and laterally align said housings with each other.

13. The apparatus according to claim 9, wherein said connecting rod is straight and rigid and having a pair of ends defining first couplers, each of said perimeter walls of said foot engaging members having a second coupler mounted thereon, said first couplers being removably attached to said second couplers to secure together and laterally align said housings with each other.

* * * * *